US010884369B2

(12) United States Patent
Motegi

(10) Patent No.: US 10,884,369 B2
(45) Date of Patent: Jan. 5, 2021

(54) IMAGE FORMING APPARATUS HAVING A DENSITY DETECTING UNIT

(71) Applicant: FUJI XEROX Co., Ltd., Tokyo (JP)

(72) Inventor: Yuma Motegi, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 16/273,356

(22) Filed: Feb. 12, 2019

(65) Prior Publication Data

US 2020/0096926 A1 Mar. 26, 2020

(30) Foreign Application Priority Data

Sep. 25, 2018 (JP) ..... 2018-179569

(51) Int. Cl.

| | |
|---|---|
| ***G03G 15/08*** | (2006.01) |
| ***G03G 15/00*** | (2006.01) |
| ***G03G 15/16*** | (2006.01) |
| ***G03G 13/02*** | (2006.01) |

(52) U.S. Cl.

CPC ..... *G03G 15/5054* (2013.01); *G03G 13/02* (2013.01); *G03G 15/1655* (2013.01)

(58) Field of Classification Search

USPC ..... 399/310

See application file for complete search history.

(56) References Cited

U.S. PATENT DOCUMENTS

| | | | | |
|---|---|---|---|---|
| 9,152,896 | B2 | 10/2015 | Kaneko et al. | |
| 2006/0177241 | A1* | 8/2006 | Sato | G03G 15/0893 399/254 |
| 2009/0304399 | A1* | 12/2009 | Morikuni | G03G 15/553 399/27 |

FOREIGN PATENT DOCUMENTS

| | | | | |
|---|---|---|---|---|
| JP | 01210979 | A * | 8/1989 | |
| JP | 04060674 | A * | 2/1992 | |
| JP | 2004004210 | A * | 1/2004 | |
| JP | 2005-031327 | A | 2/2005 | |
| JP | 2014044234 | A * | 3/2014 | G03G 15/0853 |
| JP | 2014-178404 | A | 9/2014 | |

* cited by examiner

*Primary Examiner* — Quana Grainger
(74) *Attorney, Agent, or Firm* — Sughrue Mion, PLLC

(57) ABSTRACT

An image forming apparatus includes a latent-image forming unit that forms an electrostatic latent image onto an image carrier, a developing member that develops the electrostatic latent image held on the image carrier with a developer, a container that contains the developer supplied to the developing member, a stirring member that stirs the developer by rotating in the container, a density detecting unit that is disposed in the container and that detects a density of the developer, and a switching unit that switches an image formation condition by using a period of a signal output by the density detecting unit.

8 Claims, 6 Drawing Sheets

IMAGE FORMING APPARATUS HAVING A DENSITY DETECTING UNIT

CROSS-REFERENCE TO RELATED APPLICATIONS

This application is based on and claims priority under 35 USC 119 from Japanese Patent Application No. 2018-179569 filed Sep. 25, 2018.

BACKGROUND

(i) Technical Field

The present disclosure relates to an image forming apparatus.

(ii) Related Art

Japanese Unexamined Patent Application Publication No. 2014-178404 discloses that timing correction data for correcting the timing to drive an image forming unit is acquired on the basis of a change in the density of an image pattern that is formed by changing a factor capable of adjusting the density of an image and that is detected by an image density detector. In addition, Japanese Unexamined Patent Application Publication No. 2014-178404 discloses that, when the image forming unit is controlled by using density correction data that is used for making the density of an image uniform and that corresponds to a rotation period of a rotating body, the density correction data being related to a factor capable of adjusting the density of an image, the density correction data is in a state in which the timing correction data is applied thereto.

Japanese Unexamined Patent Application Publication No. 2005-31327 discloses that a developer is caused to move by an auger and a paddle in such a manner that the amount of the developer in a detection region of an ATC sensor, which is included in a developing unit, periodically fluctuates. In addition, Japanese Unexamined Patent Application Publication No. 2005-31327 discloses that the average of values near the upper limit in a waveform of the output of the ATC sensor that periodically fluctuates is calculated as a value indicating a toner density.

There is a case where a condition, such as light exposure for forming an electrostatic latent image, is changed in accordance with a rotation phase of a developing member in order to reduce unevenness in the density of an image that is formed on a recording material. Here, when the developing member is provided with a sensor that detects a rotation phase, for example, a space occupied by the developing member becomes large, or the manufacturing costs increase.

SUMMARY

Aspects of non-limiting embodiments of the present disclosure relate to determining the timing to change conditions for image formation without including a sensor that detects a rotation phase of a developing member in the developing member.

Aspects of certain non-limiting embodiments of the present disclosure overcome the above disadvantages and/or other disadvantages not described above. However, aspects of the non-limiting embodiments are not required to overcome the disadvantages described above, and aspects of the non-limiting embodiments of the present disclosure may not overcome any of the disadvantages described above.

According to an aspect of the present disclosure, there is provided an image forming apparatus including a latent-image forming unit that forms an electrostatic latent image onto an image carrier, a developing member that develops the electrostatic latent image held on the image carrier with a developer, a container that contains the developer supplied to the developing member, a stirring member that stirs the developer by rotating in the container, a density detecting unit that is disposed in the container and that detects a density of the developer, and a switching unit that switches an image formation condition by using a period of a signal output by the density detecting unit.

BRIEF DESCRIPTION OF THE DRAWINGS

An exemplary embodiment of the present disclosure will be described in detail based on the following figures, wherein.

DETAILED DESCRIPTION

An exemplary embodiment of the present disclosure will be described below with reference to the accompanying drawings.

<Image Forming Apparatus 100>

Figure 1:
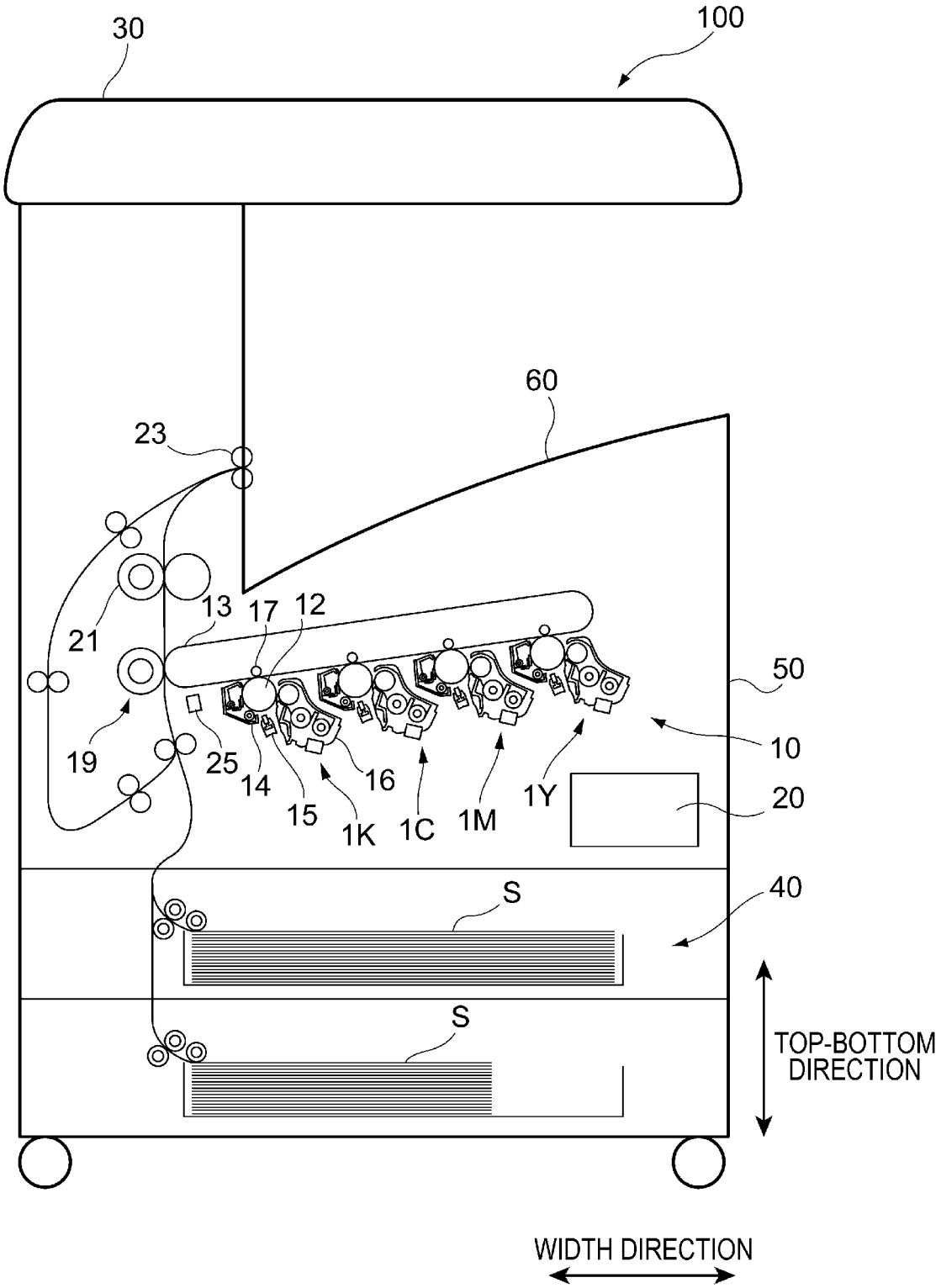
FIG. 1 is a schematic diagram illustrating a configuration of an image forming apparatus according to an exemplary embodiment of the present disclosure.

FIG. 1 is a schematic diagram illustrating a configuration of an image forming apparatus 100 according to the present exemplary embodiment. The image forming apparatus 100 illustrated in FIG. 1 is a so-called tandem type color printer. The image forming apparatus 100 includes an image forming section 10 that forms images corresponding to image data items of different colors, a controller 20 that performs overall operational control of the image forming apparatus 100, an image reading device 30 that reads an image of a document, and a sheet-feeding unit 40 that feeds sheets S to the image forming section 10.

Here, the components of the image forming apparatus 100 are accommodated in a housing 50. A stacking unit 60 is formed at a surface of an upper portion of the housing 50 positioned below the image reading device 30, and the sheets S on which images have been formed by the image forming section 10 are to be stacked on the stacking unit 60.

<Image Forming Section 10>

The image forming section 10 includes four image forming units 1Y, 1M, 1C, and 1K that are arranged side by side with a predetermined interval therebetween. Each of the image forming units 1Y, 1M, 1C, and 1K employs a so-called electrophotographic system and forms a toner image. Here, the configurations of the image forming units 1Y, 1M, 1C, and 1K are similar to one another except for the toners contained in developing units 16, which will be described later. The image forming units 1Y, 1M, 1C, and 1K form toner images of yellow (Y), magenta (M), cyan (C), and black (K), respectively. Accordingly, in the following description, reference signs "Y", "M", "C", and "K" are given to the image forming units 1Y, 1M, 1C, and 1K in order to distinguish their configurations from one another, and these reference signs will be omitted when it is not necessary to distinguish their configurations from one another.

The image forming section 10 further includes an intermediate transfer belt 13 onto which toner images of the different colors, which have been formed on photoconductor drums 12 of the image forming units 1, are transferred. The image forming section 10 further includes first transfer rollers 17 that sequentially transfer (in a first transfer process) the toner images of the different colors formed by the image forming units 1 onto the intermediate transfer belt 13. The image forming section 10 further includes a second transfer roller 19 that collectively transfers (in a second transfer process) the toner images of the different colors, which have been formed on the intermediate transfer belt 13 in such a manner as to be superposed with one another, onto one of the sheets S, a fixing device 21 that fixes the toner images of the different colors, which have been transferred to the sheet S in the second transfer process, onto the sheet S, and an ejection roller 23 that ejects the sheet S. The image forming section 10 further includes toner supply units 18 (see FIG. 5, which will be described later) that supply the toners to the developing units 16 and an image sensor 25 that detects the toner images of the different colors formed on the intermediate transfer belt 13.

<Image Forming Unit 1>

Each of the image forming units 1 includes one of the photoconductor drums 12 that holds a toner image, a charging device 14 that charges the photoconductor drum 12, an exposure unit 15 that exposes the charged surface of the photoconductor drum 12 to light and forms an electrostatic latent image, and one of the developing units 16 that develops the electrostatic latent image formed on the photoconductor drum 12 into a toner image.

<Image Forming Operation>

The image forming apparatus 100 performs a series of image forming operations under control of the controller 20. In other words, image data obtained from a personal computer (PC), which is not illustrated, or obtained by the image reading device 30 undergoes image processing performed by an image processing unit (not illustrated) and becomes image data items of different colors. Then, the image data items of the different colors are sent to the exposure units 15 of the image forming units 1. The exposure units 15 perform light exposure, and the developing units 16 perform development, so that toner images are formed onto the photoconductor drums 12.

The toner images of the different colors formed on the photoconductor drums 12 of the image forming units 1 are sequentially transferred in the first transfer process onto the intermediate transfer belt 13 by the first transfer rollers 17, and a superposed toner image, which is formed of the toner images of the different colors superposed with one another, is formed onto the intermediate transfer belt 13. Then, the superposed toner image is transported toward the second transfer roller 19 along with movement of the intermediate transfer belt 13.

Meanwhile, one of the sheets S fed by the sheet-feeding unit 40 is transported to the second transfer roller 19 in accordance with the timing at which the superposed toner image on the intermediate transfer belt 13 is transported. Then, the superposed toner image on the intermediate transfer belt 13 is transferred in the second transfer process onto the sheet S by the second transfer roller 19. The superposed toner image transferred to the sheet S is fixed onto the sheet S by the fixing device 21, after which the sheet S is ejected to the stacking unit 60 by the ejection roller 23.

Note that, in the following description, a top-bottom direction (vertical direction) of the image forming apparatus 100 illustrated in FIG. 1 may sometimes be simply referred to as the "top-bottom direction". A transverse direction of the image forming apparatus 100 as viewed in FIG. 1 may sometimes be simply referred to as a "width direction". A depth direction of the image forming apparatus 100 as viewed in FIG. 1 may sometimes be simply referred to as the "depth direction".

<Developing Unit 16>

Figure 2:
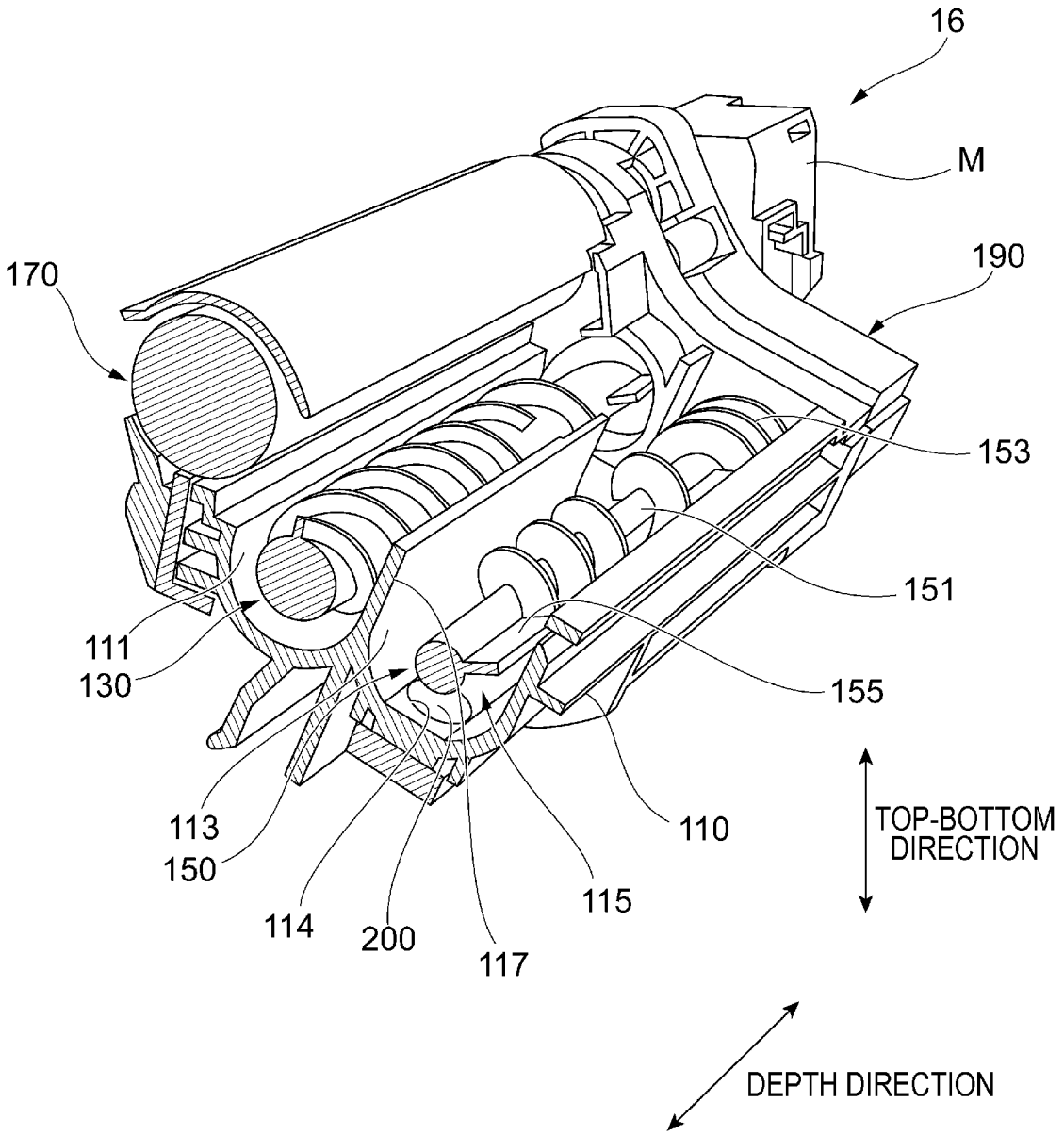
FIG. 2 is a schematic diagram illustrating a configuration of a developing unit according to the exemplary embodiment.

FIG. 2 is a schematic diagram illustrating a configuration of one of the developing units 16 according to the present exemplary embodiment. Note that a portion of the developing unit 16 illustrated in FIG. 2 is cut off in a plane perpendicular to the depth direction for the sake of clarity.

A schematic configuration of the developing unit 16 will now be described with reference to FIG. 2.

As illustrated in FIG. 2, the developing unit 16 includes a housing 110 that contains a developer, a first auger 130 and a second auger 150 that are disposed in the housing 110 and that transport the developer while stirring the developer, and a developing roller 170 that holds the developer. The developing unit 16 further includes a driving source M that is formed of a motor, a connecting unit 190 that transmits a driving force from the driving source M to the first auger 130, the second auger 150, and the developing roller 170, and a permeability sensor 200 that detects the magnetic permeability in the housing 110.

The housing 110 is open toward the photoconductor drum 12, and a developer containing chamber 115 is formed in the housing 110. A two-component developer (hereinafter referred to as developer) that is a mixture of a toner and a carrier formed of magnetic particles is contained in the developer containing chamber 115. The developer containing chamber 115 includes a first chamber 111 and a second chamber 113 that are formed by dividing the developer containing chamber 115 excluding the end portions of the developer containing chamber 115 in the depth direction into two regions by a partition plate 117 that is disposed in such a manner as to extend in the depth direction. The first auger 130 and the second auger 150 are disposed in the first chamber 111 and the second chamber 113, respectively. Here, the first auger 130 and the second auger 150 are arranged approximately parallel to the developing roller 170. The developing roller 170 is disposed approximately parallel to the photoconductor drum 12 (see FIG. 1).

Here, the first auger 130 and the second auger 150 receive a driving force from the driving source M via the connecting unit 190 and, for example, rotate in opposite directions. Note that the first auger 130 and the second auger 150 may rotate in the same direction depending on, for example, the shape of a blade 153 of each of the first auger 130 and the second auger 150. The first auger 130 and the second auger 150 cause the developer to circulate by transporting the developer toward opposite sides in the depth direction while stirring the toner supplied by one of the toner supply units 18 (see FIG. 5) and the carrier. During the above operation, the toner and the carrier are mixed together and controlled to have a predetermined toner density, and an electric charge is generated in the toner as a result of the toner and the carrier rubbing against each other.

<Second Auger 150>

The second auger 150 will now be described with reference to FIG. 2.

As illustrated in FIG. 2, the second auger 150 includes a rotary shaft 151, the blade 153 that is provided on the outer periphery of the rotary shaft 151 in a helical manner, and a paddle 155 that is a plate-shaped member provided on the outer periphery of the rotary shaft 151. The second auger 150 is a so-called admix auger that is disposed at a position that is farther from the developing roller 170 than the first auger 130 is.

Here, the paddle 155 of the second auger 150 stirs and transports the developer along with rotation of the rotary shaft 151. More specifically, the paddle 155 of the second auger 150 rotates integrally with the rotary shaft 151 and transports the developer to the vicinity of the permeability sensor 200. Although it will be described in detail later, as a result of the paddle 155 rotating along with the rotary shaft 151, the amount of the developer in a detection region of the permeability sensor 200 periodically fluctuates.

The developer transportation performance of the second auger 150 depends on the shape of the blade 153. In other words, the developer transportation performance of the second auger 150 is adjustable by parameters such as the angle of the blade 153 and the pitch of the blade 153.

<Connecting Unit 190>

Figure 3:
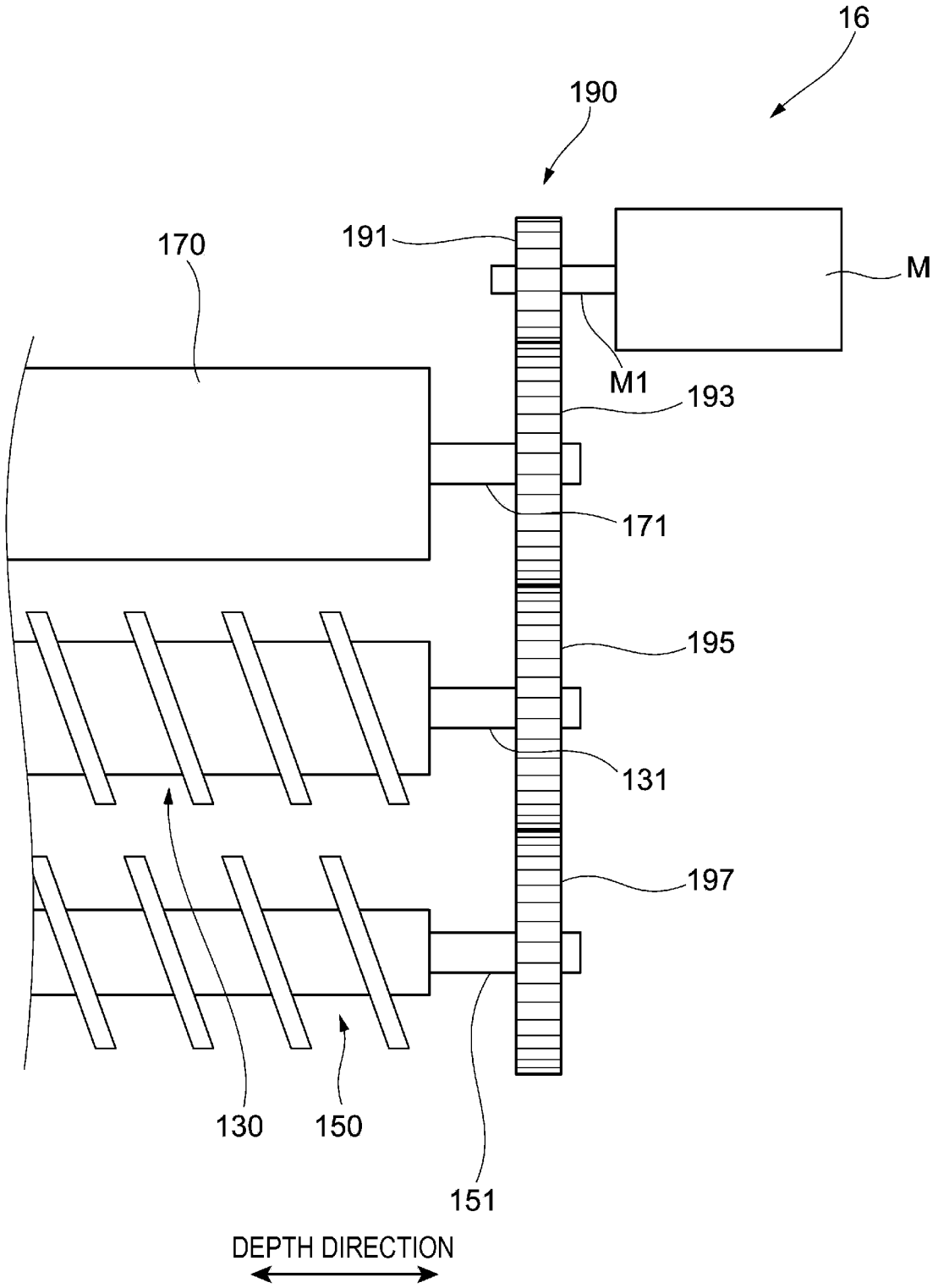
FIG. 3 is a schematic diagram illustrating a configuration of a connecting unit.

FIG. 3 is a schematic diagram illustrating a configuration of the connecting unit 190.

The connecting unit 190 will now be described with reference to FIG. 3.

As illustrated in FIG. 3, the connecting unit 190 includes a drive gear 191 provided on a rotary shaft M1 of the driving source M, a first gear 193 provided on a rotary shaft 171 of the developing roller 170, a second gear 195 provided on a rotary shaft 131 of the first auger 130, and a third gear 197 provided on the rotary shaft 151 of the second auger 150.

The first gear 193, the second gear 195, and the third gear 197 are provided so as to engage one another. Each of the first gear 193, the second gear 195, and the third gear 197 rotates by receiving a driving force from the driving source M via the drive gear 191. As a result, the developing roller 170, the first auger 130, and the second auger 150 respectively rotate about the rotary shaft 171, the rotary shaft 131, and the rotary shaft 151.

Here, in the example illustrated in FIG. 3, the number of teeth of the first gear 193, the number of teeth of the second gear 195, and the number of teeth of the third gear 197 match one another. In addition, the first gear 193, the second gear 195, and the third gear 197 receive the driving force from the common driving source M. Thus, the number of rotation of the developing roller 170, the number of rotation of the first auger 130, and the number of rotation of the second auger 150 match one another. In addition, the sizes (e.g., reference diameters) of the first gear 193, the second gear 195, and the third gear 197 match one another.

Note that the developing roller 170 and the second auger 150, which are illustrated in FIG. 3, each receive a driving force from the same driving source M in a state of being coupled to each other via the first gear 193 and the third gear 197. As a result, occurrence of a phase shift between the developing roller 170 and the second auger 150 is suppressed. In other words, a state in which the rotation phase of the developing roller 170 and the rotation phase of the second auger 150 match each other is maintained.

In addition, although a configuration has been described in which the number of teeth of the first gear 193 and the number of teeth of the third gear 197 match each other and in which the size of the first gear 193 and the size of the third gear 197 match each other, the present disclosure is not limited to this configuration. For example, the first gear 193 and the third gear 197 may have different sizes while the number of teeth of the first gear 193 and the number of teeth of the third gear 197 match each other. More specifically, the ratio of the reference diameter of the first gear 193 to the reference diameter of the third gear 197 may be, for example, 1:0.9.

In FIG. 3, the arrangement of the first gear 193, the second gear 195, and the third gear 197 in the connecting unit 190 is schematically illustrated, and the connecting unit 190 is not limited to having the illustrated arrangement. More specifically, unlike the connecting unit 190 illustrated in FIG. 3, the connecting unit 190 may include another gear other than the drive gear 191, the first gear 193, the second gear 195, and the third gear 197. For example, an intermediate gear that is disposed between the first gear 193 and the second gear 195 so as to engage the first gear 193 and the second gear 195, another intermediate gear that is disposed between the second gear 195 and the third gear 197 so as to engage the second gear 195 and the third gear 197, and the like may be provided.

<Permeability Sensor 200>

Figure 4A:
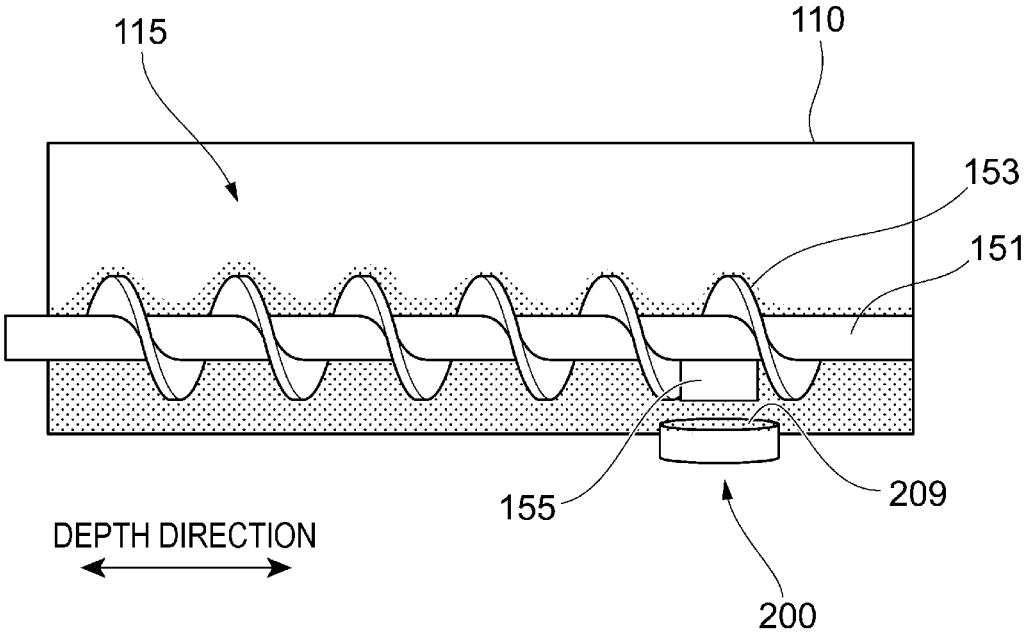
FIGS. 4A and 4B are diagrams each illustrating a configuration of a permeability sensor.
Figure 4B:
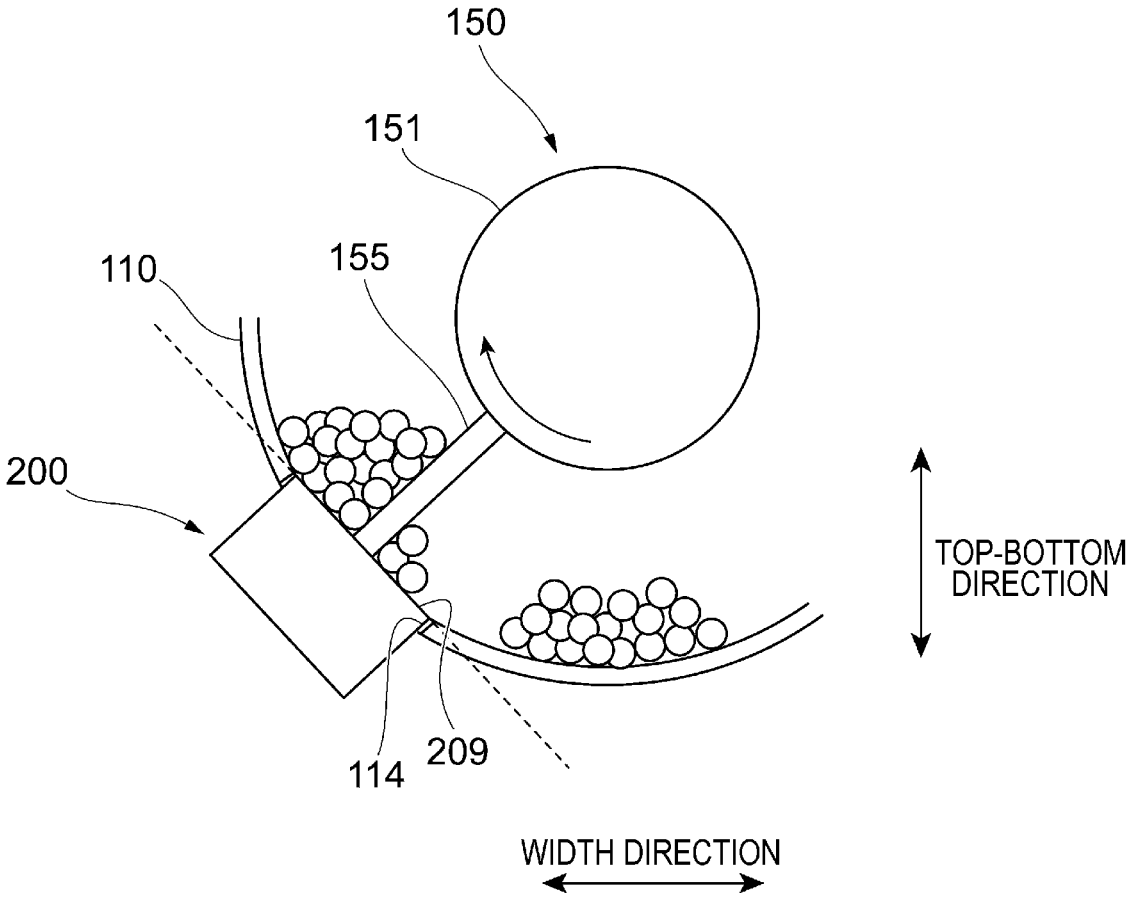

FIGS. 4A and 4B are diagrams each illustrating a configuration of the permeability sensor 200.

The configuration of the permeability sensor 200 will now be described with reference to FIG. 2 and FIGS. 4A and 4B.

As illustrated in FIG. 2, the permeability sensor 200 is disposed in the second chamber 113 of the housing 110. More specifically, the permeability sensor 200 is disposed at an opening 114 formed in the second chamber 113. The permeability sensor 200 is disposed in such a manner as to face the second auger 150 disposed in the second chamber 113. In the example illustrated in FIG. 2, the interior of the second chamber 113 is exposed to a sensor surface 209 of the permeability sensor 200 that is a surface facing the second auger 150. In addition, the permeability sensor 200 is disposed in such a manner that the detection region in which the permeability sensor 200 detects magnetic permeability overlaps a region through which the paddle 155 of the second auger 150 passes.

As illustrated in FIG. 4A, the permeability sensor 200 is disposed on the side on which an end of the rotary shaft 151 is present in the housing 110 (on the right-hand side in FIG. 4A). In addition, as illustrated in FIG. 4B, the opening 114, at which the permeability sensor 200 is disposed, is formed in the inner peripheral surface of the second chamber 113 that is a surface inclined with respect to the horizontal direction (the width direction). In the example illustrated in FIGS. 4A and 4B, the sensor surface 209 of the permeability sensor 200 is a flat surface, and the interior of the second chamber 113 is exposed to the sensor surface 209 through the opening 114. The sensor surface 209 is inclined with respect to the horizontal direction (see a dashed line extending along the sensor surface 209 in FIG. 4B). As described above, by employing the arrangement in which the inner peripheral surface of the second chamber 113 and the sensor surface 209 of the permeability sensor 200 are inclined with respect to the horizontal direction, the developer falls along the inner peripheral surface of the second chamber 113 and the sensor surface 209 of the permeability sensor 200.

Here, as illustrated in FIG. 4B, along with rotation of the second auger 150, the developer that is present in front of the sensor surface 209 of the permeability sensor 200 is caused to move by being scraped up by the paddle 155. The second auger 150 rotates at a predetermined speed. Accordingly, the amount of the developer in the detection region of the permeability sensor 200 periodically fluctuates. As a result, an output signal (e.g., voltage) from the permeability sensor 200 also periodically changes along with rotation of the second auger 150.

Here, the developer falls along the inner peripheral surface of the second chamber 113 or the sensor surface 209 of the permeability sensor 200, so that the amount of the developer remaining in front of the sensor surface 209 of the permeability sensor 200 is reduced after the paddle 155 has passed in front of the sensor surface 209. Consequently, along with the passage of the paddle 155, the magnetic permeability, that is, the output signal of the permeability sensor 200 will be markedly changed, and as a result, for example, the precision with which the period of the output signal is detected may be improved.

<Controller 20>

Figure 5:
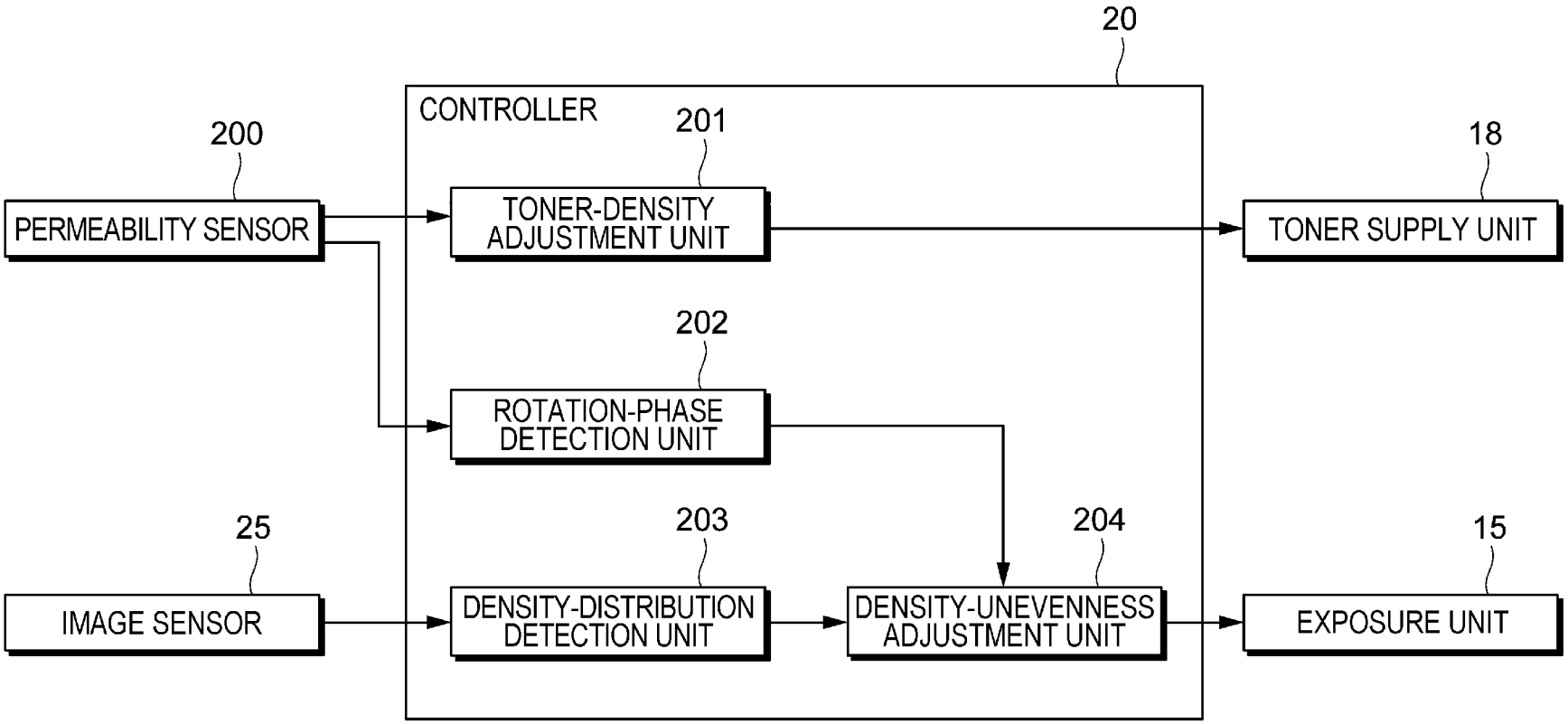
FIG. 5 is a diagram illustrating a configuration of a controller.

FIG. 5 is a diagram illustrating a configuration of the controller 20.

The controller 20 will now be described with reference to FIG. 2 and FIG. 5.

As illustrated in FIG. 5, the controller 20 includes a toner-density adjustment unit 201 that receives a signal from the permeability sensor 200 and adjusts a toner density, a rotation-phase detection unit 202 that receives a signal from the permeability sensor 200 and detects a rotation phase of the second auger 150, a density-distribution detection unit 203 that receives a signal from the image sensor 25 and detects a density distribution in a toner image, and a density-unevenness adjustment unit 204 that receives a signal indicating the rotation phase of the second auger 150 from the rotation-phase detection unit 202 and a signal indicating a density distribution in a toner image from the density-distribution detection unit 203 and adjusts the unevenness in the density of the toner image.

Here, the toner-density adjustment unit 201 detects the toner density (the ratio of the toner to the carrier) of the developer by using the output value of the permeability sensor 200 and controls the toner supply units 18 on the basis of the detected value. More specifically, the toner-density adjustment unit 201 controls the toner supply units 18 in such a manner that the toner density is kept within a predetermined range as a result of the toner being supplied by the toner supply units 18.

The rotation-phase detection unit 202 detects the rotation phase of the second auger 150 by using the output value of the permeability sensor 200 and outputs the detected rotation phase to the density-unevenness adjustment unit 204. Here, as mentioned above, the number of rotation of the second auger 150 and the number of rotation of the developing roller 170 match each other. Thus, in the present exemplary embodiment, the rotation phase of the second auger 150 is used as the rotation phase (so-called Z phase) of the developing roller 170.

The density-distribution detection unit 203 detects a signal from the image sensor 25, the signal indicating different color toner images for density unevenness detection that are formed on the intermediate transfer belt 13, and detects the density distribution in each of the toner images.

The density-unevenness adjustment unit 204 detects, on the basis of the rotation phase of the developing roller 170 detected by the rotation-phase detection unit 202 and the density distribution detected by the density-distribution detection unit 203, the relationship between the rotation phase of the developing roller 170 and the density unevenness in each of the different color toner images for density unevenness detection. In addition, the density-unevenness adjustment unit 204 generates a correction parameter for correcting detected density unevenness. Furthermore, the density-unevenness adjustment unit 204 controls, on the basis of a correction parameter generated thereby and the rotation phase of the developing roller 170 detected by the rotation-phase detection unit 202, the light exposure of the exposure units 15 when electrostatic latent images are formed on the surface of the photoconductor drums 12.

Here, the density unevenness refers to variations in the density of an image that is formed on one of the sheets S so as to have a uniform image density. For example, an image having a predetermined density is formed as a toner image for density unevenness detection such that the image has a size corresponding to the entire surface of one of the sheets S, and the density unevenness is represented by differences (variations) in the image density of the image. The density unevenness occurs due to various factors such as, for example, swinging of the photoconductor drums 12 and unevenness in the light exposure of the exposure units 15.

When the density-unevenness adjustment unit 204 adjusts the density unevenness, different color toner images for density unevenness detection are each divided into areas in two directions (e.g., the width direction and the depth direction). Then, a correction parameter for correcting the density unevenness such as that mentioned above is generated for each of the areas. Note that, in the example illustrated in FIG. 5, density correction is performed so as to cancel out the density unevenness by synchronizing the rotation phase of the developing roller 170 and an adjustment timing of a correction parameter. For example, the timing to switch the light exposure of the exposure units 15 in accordance with the correction parameter may be determined from the rotation phase of the developing roller 170.

Unlike the present exemplary embodiment, in order to determine the rotation phase of the developing roller 170 that is to be measured, for example, a configuration in which the developing roller 170 is provided with a rotation-phase detection device such that the rotation-phase detection device directly detects the rotation phase of the developing roller 170 may be employed. However, in this configuration, the rotation-phase detection device may sometimes need to be disposed in the developing unit 16 for correcting density unevenness. This case requires the manufacture of the rotation-phase detection device and a space for the rotation-phase detection device to be placed. The case also requires structural design of the rotation-phase detection device or electrical design including input and output, and this leads to an increase in the manufacturing costs and a spatial limitation. In contrast, in the present exemplary embodiment, the developing roller 170 is not provided with such a rotation-phase detection device, and the rotation phase of the developing roller 170 is detected by the permeability sensor 200 provided for the second auger 150.

<Output Signal of Permeability Sensor 200>

Figure 6:
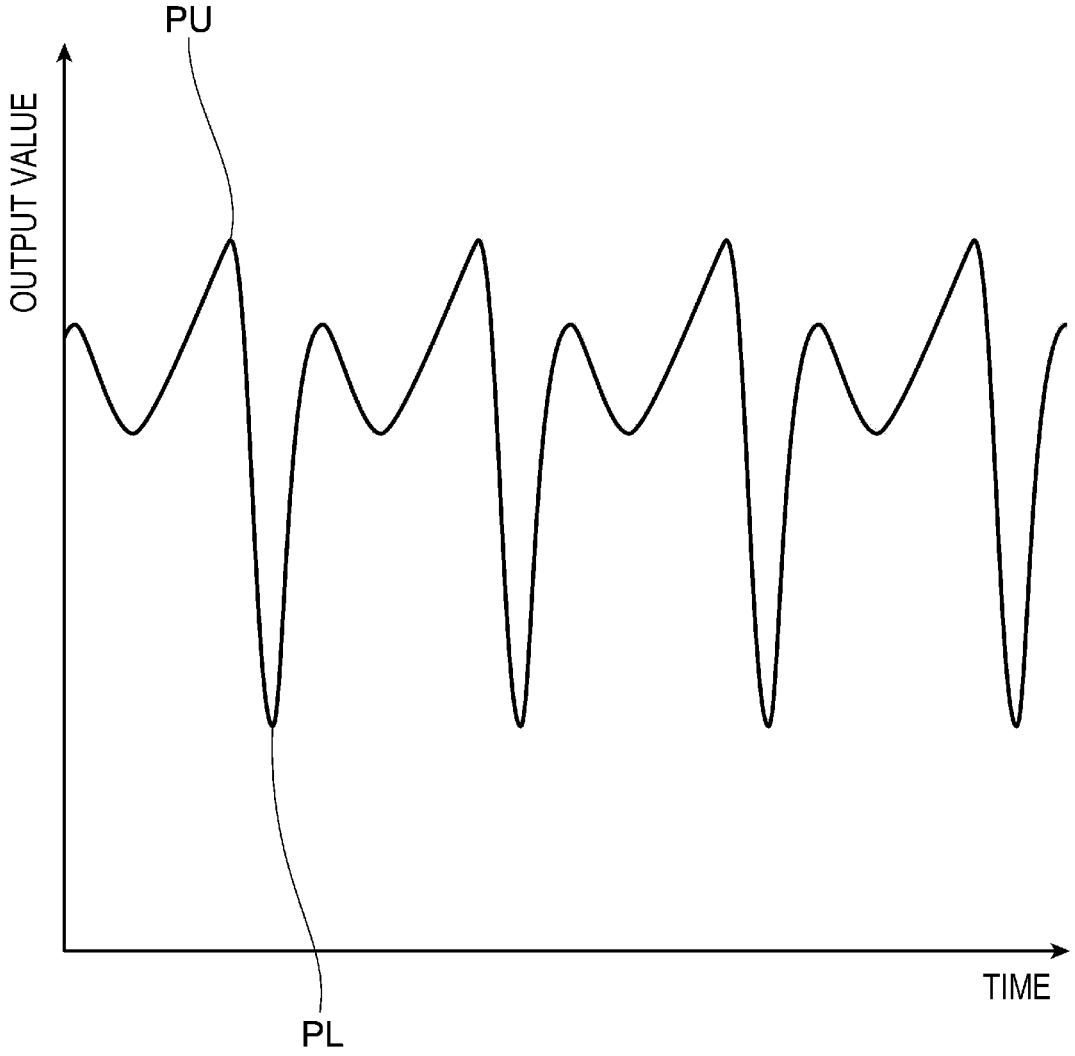
FIG. 6 is a graph illustrating an output signal of the permeability sensor.

FIG. 6 is a graph illustrating an output signal of the permeability sensor 200.

An output signal of the permeability sensor 200 will now be described with reference to FIG. 2 and FIG. 6.

As illustrated in FIG. 6, each time the permeability sensor 200 detects the paddle 155 passing in front of the permeability sensor 200, it is detected that the output signal of the permeability sensor 200 reaches its peak. More specifically, the developer in the detection region of the permeability sensor 200 periodically fluctuates along with rotation of the second auger 150. Thus, the output signal of the permeability sensor 200 that detects the magnetic permeability of the developer has a waveform that periodically fluctuates while reaching its peak. In the example illustrated in FIG. 6, the output value of the permeability sensor 200 periodically fluctuates over time, that is, with changes in the rotation phase of the second auger 150. More specifically, the output value of the permeability sensor 200 periodically changes between an upper peak PU and a lower peak PL.

The second auger 150 makes one rotation in one period of the output signal of the permeability sensor 200, which is, for example, during the period from when the output signal reaches the lower peak PL until the output signal reaches the next lower peak PL. In other words, the rotation phase of the second auger 150 may be detected by detecting periodical fluctuations in the output signal of the permeability sensor 200.

Accordingly, in the example illustrated in FIG. 6, the density-unevenness adjustment unit 204 switches, by using timings at which the output signal of the permeability sensor 200 periodically reaches its maximum value and/or its minimum value, conditions under which the exposure units 15 form electrostatic latent images. For example, the rotation period of the second auger 150 may be determined by detecting the lower peak PL and the next lower peak PL. Alternatively, the rotation period of the second auger 150 may be determined by using a combination of, for example, the upper peak PU and the next upper peak PU or the upper peak PU and the next lower peak PL. Note that, by determining the rotation period of the second auger 150 by using the upper peak PU or the lower peak PL, which is relatively easily detectable, the accuracy with which the rotation period of the second auger 150 is calculated is improved.

In addition, in the example illustrated in FIG. 6, the degree of fluctuations between before and after the lower peak PL is larger than the degree of fluctuations between before and after the upper peak PU. In other words, the waveform of the lower peak PL is sharper than the waveform of the upper peak PU. In the case where the sharpness of the upper peak PU and the sharpness of the lower peak PL are different from each other as mentioned above, the accuracy with which the rotation phase of the second auger 150 is calculated may be improved by using the sharper peak (the lower peak PL in the example illustrated in FIG. 6).

In the case where the rotation phase of the developing roller 170 is calculated by using a plurality of lower peaks PL in a predetermined period of time, the rotation phase of the developing roller 170 is calculated with higher accuracy compared with the case where the rotation phase of the developing roller 170 is calculated by using only one period from the lower peak PL to the next lower peak PL. In other words, by performing filtering using a plurality of waveforms of the permeability sensor 200, the accuracy with which the rotation phase is calculated is improved.

The rotation phases of the second auger 150 and the developing roller 170 and also the toner density of the developer are calculated from the output signal of the permeability sensor 200 illustrated in FIG. 6. More specifically, the toner density is calculated from the magnitude of the output signal of the permeability sensor 200. For example, the toner density may be calculated by using the average of the output values of the lower peaks PL in a predetermined period of time. In this case, by performing filtering using the output values of a plurality of lower peaks PL, the accuracy with which the toner density is calculated is improved.

As an additional point, the permeability sensor 200 detects the toner density of the developer in the developer containing chamber 115, that is, the ratio of the toner to the carrier, by detecting the magnetic force (magnetic permeability) of the carrier in the developer containing chamber 115. For example, when the magnetic permeability detected by the permeability sensor 200 is relatively high, the amount of the carrier in the developer is relatively large, and the amount of the toner in the developer is relatively small. In other words, the toner density is low in this case. In contrast, when the magnetic permeability detected by the permeability sensor 200 is relatively low, the amount of the carrier in the developer is relatively small, and the amount of the toner in the developer is relatively large. In other words, the toner density is high in this case. The operational state of the toner supply unit 18 is switched in accordance with the toner density detected in the manner described above.

<Modification>

In the above description, although a configuration has been described in which the number of rotation of the second auger 150 and the number of rotation of the developing roller 170 match each other, the present disclosure is not limited to this configuration as long as the number of rotation of the developing roller 170 may be determined on the basis of the number of rotation of the second auger 150. For example, in the configuration in which the developing roller 170 and the second auger 150 each receive a driving force from the same driving source M and are coupled to each other via their gears, the number of rotation of the developing roller 170 may be an integral multiple of the number of rotation of the second auger 150.

Alternatively, a configuration may be employed in which the number of rotation of the second auger 150 and the number of rotation of a corresponding one of the photoconductor drums 12 match each other. More specifically, in the configuration in which the second auger 150 and the photoconductor drum 12 each receive a driving force from the same driving source M and are coupled to each other via their gears, the number of rotation of the photoconductor drum 12 may be an integral multiple of the number of rotation of the second auger 150. In this configuration, the rotation phase of the photoconductor drum 12 is determined by using the rotation phase of the second auger 150.

Alternatively, a configuration may be employed in which the number of rotation of the second auger 150, the number of rotation of the developing roller 170, and the number of rotation of the photoconductor drum 12 match one another. Alternatively, a configuration may be employed in which the number of rotation of the second auger 150 functions as a reference and in which the number of rotation of the developing roller 170 and the number of rotation of the photoconductor drum 12 are each an integral multiple of the reference number of rotation. More specifically, in the configuration in which the second auger 150, the developing roller 170, and the photoconductor drum 12 each receive a driving force from the same driving source M and are coupled to one another via their gears, the number of rotation of the photoconductor drum 12 and the number of rotation of the developing roller 170 may each be an integral multiple of the number of rotation of the second auger 150. In this configuration, the rotation phase of the developing roller 170 and the rotation phase of the photoconductor drum 12 are determined by using the rotation phase of the second auger 150. In other words, the rotation phases of a plurality of other rotating bodies are determined from the rotation phase of the second auger 150.

As long as the number of rotation of a target rotating body may be determined from the number of rotation of the second auger 150, the target rotating body is not limited to a roll-shaped member, such as the developing roller 170 or the photoconductor drum 12, and may be a rotating body having a different shape such as the intermediate transfer belt 13. In addition, although a configuration has been described above in which the second auger 150, the developing roller 170, and so forth receive a driving force from the same driving source M, a configuration in which the second auger 150, the developing roller 170, and so forth receive a driving force from different driving sources may be employed as long as the number of rotations of the second auger 150, the developing roller 170, and so forth may be determined.

In the above description, it has been described that the rotation phase of the second auger 150 is determined by using the permeability sensor 200. Here, a configuration for determining the rotation phase of the second auger 150 is not particularly limited as long as the rotation phase of the second auger 150 may be determined. For example, instead of the permeability sensor 200, a sensor employing a different method such as an optical sensor may be used for detecting the toner density and the rotation phase of the second auger 150.

In addition, although it has been described above that density unevenness is corrected by controlling the light exposure of the exposure units 15, the present disclosure is not limited to this as long as image formation conditions are adjusted by using the rotation phase of the developing roller 170, which is detected by the rotation-phase detection unit 202, so as to correct density unevenness. For example, density unevenness may be corrected by controlling the charging bias of the charging devices 14 or the developing bias of the developing units 16. As an additional point, density unevenness may be corrected by controlling the magnitude of the charging bias or the magnitude of the developing bias or by modulating the speed of a motor serving as a roller driving source. Alternatively, density unevenness may be corrected by adding density unevenness that is opposite to the density unevenness that is expected to occur to image data of an image to be formed.

Note that, in the above description, each of the developing units 16 is an example of a developing device. Each of the photoconductor drums 12 is an example of an image carrier. Each of the developing rollers 170 is an example of a developing member. Each of the housings 110 is an example of a container. Each of the second augers 150 is an example of a stirring member. Each of the permeability sensors 200 is an example of a density detecting unit and an example of a phase detecting unit. The density-unevenness adjustment unit 204 is an example of a switching unit and an example of a changing unit.

Note that although the exemplary embodiment and the modification have been described above, it is obvious that the exemplary embodiment and the modification may be combined.

In addition, the present disclosure is in no way limited to the above exemplary embodiment, and various modifications may be made within the gist of the present disclosure.

The foregoing description of the exemplary embodiment of the present disclosure has been provided for the purposes of illustration and description. It is not intended to be exhaustive or to limit the disclosure to the precise forms disclosed. Obviously, many modifications and variations will be apparent to practitioners skilled in the art. The embodiment was chosen and described in order to best explain the principles of the disclosure and its practical applications, thereby enabling others skilled in the art to understand the disclosure for various embodiments and with the various modifications as are suited to the particular use contemplated. It is intended that the scope of the disclosure be defined by the following claims and their equivalents.

What is claimed is:

1. An image forming apparatus comprising:

a latent-image forming unit comprising a light source, wherein the latent-image forming unit is configured to form an electrostatic latent image onto an image carrier;

a developing member comprising a developing roller, wherein the developing member is configured to develop the electrostatic latent image held on the image carrier with a developer;

a container that contains the developer supplied to the developing member;

a stirring member comprising an auger, wherein the stirring member is configured to stir the developer by rotating in the container;

a sensor disposed in the container;

at least one processor configured to execute a density detecting unit using the sensor, wherein the density detecting unit is configured to detect a density of the developer;

a switching unit configured to switch an image formation condition by using a period of a signal output by the density detecting unit; and a single driving source configured to drive both the developing member and the stirring member, wherein the density detecting unit is configured to detect a change in a magnetic permeability in the container, and wherein the density detecting unit is configured to detect a change in the magnetic permeability in a region extending along an inner surface of the container, the inner surface being inclined with respect to a horizontal direction.

2. The image forming apparatus according to claim 1, wherein the density detecting unit is configured to switch, by using a timing at which the magnetic permeability periodically reaches a maximum value and/or a minimum value, a condition under which the latent-image forming unit forms an electrostatic latent image.

3. The image forming apparatus according to claim 1, wherein a number of rotations of the developing member is an integral multiple of the number of rotation of the stirring member.

4. The image forming apparatus according to claim 3, wherein the number of rotations of the stirring member and the number of rotation of the developing member match each other.

5. An image forming apparatus comprising:

a latent-image forming unit comprising a light source, wherein the latent-image forming unit is configured to form an electrostatic latent image onto an image carrier;

a developing member comprising a developing roller, wherein the developing member is configured to develop the electrostatic latent image held on the image carrier with a developer;

a container that contains the developer supplied to the developing member;

a stirring member comprising an auger, wherein the stirring member is configured to stir the developer by rotating in the container;

a sensor disposed in the container;

at least one processor configured to execute:

a density detecting unit using the sensor;

wherein the density detecting unit is configured to detect a density of the developer;

a phase calculating unit configured to calculate a rotation phase of the stirring member; and a changing unit configured to change an image formation condition by using the rotation phase detected by the phase detecting unit; and a single driving source configured to drive both the developing member and the stirring member, wherein the density detecting unit is configured to detect a change in a magnetic permeability in the container, and wherein the density detecting unit is configured to detect a change in the magnetic permeability in a region extending along an inner surface of the container, the inner surface being inclined with respect to a horizontal direction.

6. An image forming apparatus comprising:

a latent-image forming means for forming an electrostatic latent image onto an image carrier;

a developing means for developing the electrostatic latent image held on the image carrier with a developer;

a container means for containing the developer supplied to the developing means;

a stirring means for stirring the developer by rotating in the container;

a density detecting means, disposed in the container means, for detecting a density of the developer;

a switching means for switching an image formation condition by using a period of a signal output by the density detecting means; and a single driving means configured to drive both the developing means and the stirring means, wherein the density detecting means is configured to detect a change in a magnetic permeability in the container means, and wherein the density detecting means is configured to detect a change in the magnetic permeability in a region extending along an inner surface of the container means, the inner surface being inclined with respect to a horizontal direction.

7. The image forming apparatus according to claim 1, wherein the auger comprises a paddle, and wherein the sensor is configured to detect magnetic permeability in a detection region that overlaps with a region through which the paddle passes.

8. The image forming apparatus according to claim 1, wherein the switching unit is configured to switch the image formation condition by using the period of the signal output by the density detecting unit to determine a rotation period of the auger.

* * * * *